US011754058B2

(12) United States Patent
Wu et al.

(10) Patent No.: US 11,754,058 B2
(45) Date of Patent: Sep. 12, 2023

(54) INTELLIGENT CONTROL GAS SUCTION-TYPE ELECTRIC PROPULSION SYSTEM APPLICABLE TO MULTI-FLOW REGIMES

(71) Applicant: NATIONAL UNIVERSITY OF DEFENSE TECHNOLOGY, Hunan (CN)

(72) Inventors: Jianjun Wu, Hunan (CN); Yu Zhang, Hunan (CN); Biqi Wu, Hunan (CN); Yuqiang Cheng, Hunan (CN); Jian Li, Hunan (CN); Sheng Tan, Hunan (CN); Yang Ou, Hunan (CN); Peng Zheng, Hunan (CN); Yuanzheng Zhao, Hunan (CN); Haoyi Wang, Hunan (CN)

(73) Assignee: NATIONAL UNIVERSITY OF DEFENSE TECHNOLOGY, Hunan (CN)

( * ) Notice: Subject to any disclaimer, the term of this patent is extended or adjusted under 35 U.S.C. 154(b) by 205 days.

(21) Appl. No.: 17/605,568

(22) PCT Filed: Sep. 30, 2020

(86) PCT No.: PCT/CN2020/119594

§ 371 (c)(1),
(2) Date: Oct. 21, 2021

(87) PCT Pub. No.: WO2021/082873

PCT Pub. Date: May 6, 2021

(65) Prior Publication Data

US 2022/0205436 A1 Jun. 30, 2022

(30) Foreign Application Priority Data

Oct. 29, 2019 (CN) ..... 201911040221.0

(51) Int. Cl.
*F03H 1/00* (2006.01)

(52) U.S. Cl.
CPC ..... *F03H 1/0006* (2013.01); *F03H 1/0037* (2013.01); *F03H 1/0081* (2013.01)

(58) Field of Classification Search
CPC ..... F03H 1/0006; F03H 1/0037; F03H 1/0081
See application file for complete search history.

(56) References Cited

U.S. PATENT DOCUMENTS 5,947,421 A * 9/1999 Beattie ..... B64G 1/405 244/171.1
9,103,329 B2 * 8/2015 Corbett ..... F03H 1/0018
(Continued)

FOREIGN PATENT DOCUMENTS

CN 102767497 11/2012
CN 103453805 12/2013
(Continued)

OTHER PUBLICATIONS

"International Search Report (Form PCT/ISA/210) of PCT/CN2020/119594," dated Dec. 30, 2020, with English translation thereof, pp. 1-6.

(Continued)

*Primary Examiner* — Lorne E Meade
(74) *Attorney, Agent, or Firm* — JCIP GLOBAL INC.

(57) ABSTRACT

An intelligent control gas suction-type electric propulsion system applicable to multi-flow regimes: an ultra-low orbit rare gas is used as a working medium for attitude orbit control and resistance compensation propulsion, the gas is collected and inputted into an intelligent feedback pressurization system by means of a parabolic gas intake duct, intelligent feedback and pressurization are performed on the gas working medium by a molecular pump and a gas pump and the medium is stored in a working fluid storage tank so as to supply a hybrid thruster system that consists of seven sets of electric thrusters to generate thrust, which may (Continued)

achieve multiple thrust modes, and achieve the purpose of attitude orbit control and resistance compensation.

10 Claims, 2 Drawing Sheets

(56) References Cited

U.S. PATENT DOCUMENTS

| | | | | |
|---|---|---|---|---|
| 10,961,989 | B2 * | 3/2021 | Mazouffre | F03H 1/0006 |
| 2022/0205436 | A1 * | 6/2022 | Wu | F03H 1/0012 |

FOREIGN PATENT DOCUMENTS

| | | |
|---|---|---|
| CN | 105156290 | 12/2015 |
| CN | 109595133 | 4/2019 |
| CN | 109983217 | 7/2019 |
| CN | 110159502 | 8/2019 |
| CN | 110374830 | 10/2019 |
| CN | 110748467 | 2/2020 |
| RU | 2244159 | 1/2005 |

OTHER PUBLICATIONS

"Written Opinion of the International Searching Authority (Form PCT/ISA/237) of PCT/CN2020/119594," dated Dec. 30, 2020, pp. 1-4.

* cited by examiner

INTELLIGENT CONTROL GAS SUCTION-TYPE ELECTRIC PROPULSION SYSTEM APPLICABLE TO MULTI-FLOW REGIMES

CROSS-REFERENCE TO RELATED APPLICATION

This application is a 371 of international application of PCT application serial no. PCT/CN2020/119594, filed on Sep. 30, 2020, which claims the priority benefits of China application no. 201911040221.0, filed on Oct. 29, 2019. The entirety of each of the above-mentioned patent applications is hereby incorporated by reference herein and made a part of this specification.

TECHNICAL FIELD

The invention belongs to the technical field of electric space propulsion, and particularly, relates to an intelligent-control atmosphere-breathing electric propulsion system capable of realizing flexible orbit transfer and applicable to a continuous flow and a free molecular flow.

DESCRIPTION OF RELATED ART

With the development of space technology, space orbits are gradually reaching a saturation point. The space region of ultralow orbits at an altitude of 50 km-250 km has a great development potential for the operation of satellites, and the low orbit altitude can greatly improve the efficiency of satellite-borne equipment on the orbits at this altitude, thus having high development value in the fields of space meteorology, atmospheric models, earth electric field monitoring, and earth remote sensing. However, compared with a vacuum environment of high orbits, due to the rarefied atmosphere of ultralow orbits, an aircraft will generate an aerodynamic resistance that may lower the orbit altitude when working at an ultralow orbit, thus limiting the working life of satellites. So, this orbit region has not been not completely developed at present.

The atmospheric environment at the altitude of 50 km-250 km varies drastically. With the increase of the orbit altitude, the atmospheric density decreases continuously, and the orbit atmosphere transits from a continuous flow state to a free molecular flow state. In special working environments, special working requirements will be put forward to aircrafts.

Electric propulsion has the characteristics of stable performance, high specific impulse, adjustable thrust, low cost, and the like, and has become a research focus in the space propulsion field at present. Electric propulsion has good effects and performance in the aspect of resistance compensation because of its properties. The GOCE satellite of the European Space Agency, carrying 40 kg of xenon working medium, has fulfilled a mission life over 4 years on a 220 km orbit by using an electric propulsion system for resistance compensation, which proves that it is feasible to use atmosphere-breathing electric propulsion for resistance compensation.

However, the airborne propellant amount still limits the working life of satellites. When the propellant used for resistance compensation is exhausted, the satellites will be unable to stay on the orbit under the influence of the aerodynamic resistance and will lose their stable orbit and fall. If too much propellant is carried, the effective load will be limited, and the emission difficulty will be increased.

Considering that the electric propulsion technique can use gases as a working medium to carry out ionization propulsion, in order to extend the working life and improve the effective load, the orbit atmosphere can be collected to be used as the working medium for propulsion, so resistance compensation can be completed on an ultralow orbit under the condition where little or even no working medium is carried.

SUMMARY

To solve the problem that ultralow orbits at an altitude of 50 km-250 km are not completely developed due to the existence of resistance, the invention provides an atmosphere-breathing electric propulsion system, which is able to work on different orbits, provided with an intelligent feedback pressurization system, and capable of realizing orbital attitude control and resistance compensation. The atmosphere-breathing electric propulsion system of the invention can maneuver flexibly within an ultralow orbit range of 50 km-250 km and work in a low-orbit continuous flow state, a high-orbit free molecular flow state, and a transitional flow state between the low-orbit continuous flow state and the high-orbit free molecular flow state, thus meeting different mission requirements.

The technical solution of the invention is as follows:

An intelligent-control atmosphere-breathing electric propulsion system applicable to multiple flow states, consisting of a gas intake duct, an intelligent feedback pressurization system, a hybrid thruster system, a control system, and an energy supply system.

The gas intake duct is parabolic and comprises a front inlet and a rear outlet, the front inlet is a windward portion of the system, the rear outlet is connected to the intelligent feedback pressurization system, and the gas intake duct is used for preliminarily compressing an incoming gas.

The intelligent feedback pressurization system comprises a pump body, pressure gauges and a working medium storage tank.

The pump body comprises a molecular pump suitable for a free molecular flow, and an air pump suitable for a low-pressure continuous flow, the molecular pump, the air pump, and the working medium storage tank are serially connected in an incoming flow sequence, the molecular pump is connected to the rear outlet of the gas intake duct. Two pressure gauges are disposed at a front end of the air pump and the working medium storage tank respectively and connected to the control system, used for feedback control of power of the molecular pump and power of the air pump respectively.

The hybrid thruster system comprises seven electric thrusters and seven flow-limiting valves, the control system controls power of the electric thrusters and a flow rate of the flow-limiting valves.

Electric thrusters of the hybrid thruster system are arranged parallelly and closely, and comprise four magnetic plasma thrusters and three ion thrusters.

The control system is provided with a wireless signal receiver and a wired signal input port, and controls working states of the intelligent feedback pressurization system and the hybrid thruster system by processing wireless remote control signals and input feedback signals.

The energy supply system comprises a battery and solar panels, and the solar panels cover surfaces of a housing of the electric propulsion system, do not generate an extra resistance, and are kept in a charging state during work. The energy supply system is connected to the intelligent feedback pressurization system, the hybrid thruster system, and the control system and supplies power to the intelligent feedback pressurization system, the hybrid thruster system, and the control system. To guarantee solar power supply efficiency, a satellite orbit employing the system is defined as a sun-synchronous orbit.

The gas intake duct produces a shock wave effect in a continuous flow gaseous environment to compress an incoming gas flow, compresses incoming gaseous particles by means of a parabolic mirror-reflection focusing effect in a free molecular flow gaseous environment, and combines the two effects in a transitional flow state. After being preliminarily compressed, the gas enters the intelligent feedback pressurization system to be further supercharged, so that a good compression effect is realized in different orbital atmospheric environments.

Negative feedback control of the working state of the molecular pump is performed by the first pressure gauge. When an air pressure communicated with the first pressure gauge does not meet working requirements of the air pump, the control system increases the power of the molecular pump to increase a gas density in the system. Generally, a molecular pump works when an atmospheric environment is in a free molecular flow state.

Negative feedback control of the working state of the air pump is performed by the second pressure gauge. When an air pressure of the working medium storage tank communicated with the second pressure gauge does not reach a rated value, the control system controls the air pump to work continuously; and the smaller a reading of the second pressure gauge, the higher the working power of the air pump, so that it is guaranteed that a working medium in the working medium storage tank meets mission requirements.

Preferably, the hybrid thruster system is provided with four magnetic plasma thrusters as well as three ion thrusters, in a high-flow rate environment, the magnetic plasma thruster that require a high flow rate for ignition and have a large thrust density are started; and in a low-flow rate environment, the ion thruster that require a low flow rate for ignition and have a small thrust density and a high control accuracy are started.

Preferably, a focus of a parabola of the parabolic gas intake duct is located outside the rear outlet of the gas intake duct. In a free molecular flow environment, a thermal velocity of molecules is far smaller than a speed of an aircraft, and incoming molecules are regarded as a horizontal incoming flow. Because of a geometric focusing characteristic of the parabola, particles entering the gas intake duct will be focused to the focus of the parabola under the mirror-reflection effect of a wall of the gas intake duct; and the focus is designed to be located outside the rear outlet, so that intake efficiency of the gas intake duct is effectively improved.

Preferably, a coating on a wall of the gas intake duct is a magnesium fluoride mirror coating suitable for an oxygenic high-temperature environment, so that air-intake efficiency of a rarefied atmospheric free molecular flow is improved when the system works in a low-flow rate environment.

Preferably, a conductive portion of the hybrid thruster system is coated with a gold coating, and a non-conductive portion of the hybrid thruster system is made of a ceramic material; and an air duct of the intelligent feedback pressurization system and the gas intake duct are made of a stainless steel material containing nickel and molybdenum.

Preferably, the solar panels of the energy supply system cover four vertical surfaces in a flight direction, and the flight direction is parallel to an inlet surface of the gas intake duct and an outlet surface of the hybrid thruster system, so that the solar panel will not generate any extra resistance.

Preferably, equipment on a satellite employing the electric propulsion system is disposed in a hexahedron formed by the gas intake duct, the hybrid thruster system, and four said solar panels, and the satellite is elongated to work under a minimum resistance.

Preferably, the seven thrusters in the hybrid thruster system are closely arranged in parallel, wherein the first magnetic plasma thruster is located at a central point, and the other three magnetic plasma thrusters and the three ion thrusters are alternately arranged with six vertexes of a regular hexagon as centers.

Preferably, one said flow-limiting valve is connected to a front end of each of the seven electric thrusters in the hybrid thruster system, and the control system controls the seven electric thrusters and the flow-limiting valves separately to realize different thrust states.

Preferably, the hybrid thruster system is provided with four magnetic plasma thrusters as well as three ion thrusters; for special task requirements, the two types of thrusters work collaboratively under the condition where the working medium in the working medium storage tank is sufficient, the working power of the thrusters and the flow rate of the flow-limiting valves are controlled by the control system to accurately control thrust of the thrusters, and the thrust of the seven thrusters is controlled separately to generate a resultant force and a force moment to meet mission requirements for orbital attitude control and resistance compensation.

The invention has the following beneficial effects:

1. The atmosphere-breathing electric propulsion system of the invention can take in the atmosphere as a working medium for discharge to generate thrust to allow satellites to work for a long time under the condition where little or even no working medium is carried, so that the effective load is increased, and the launching and operating costs of the satellites are reduced;
2. The hybrid thruster system of the invention can realize orbit transfer, resistance compensation and attitude adjustment by controlling thrust separately, so that satellites can maneuver flexibly within a working orbit range according to mission requirements;
3. The atmosphere-breathing electric propulsion system of the invention improves the feasibility of satellites working on ultralow orbits at an altitude of 50 km-250 km, and compared with satellites working on orbits at other altitudes, the satellites working on the ultralow orbits have higher equipment efficiency and can meet more mission requirements;
4. One advantage of the invention lies in that satellites working at ultralow orbits will rapidly fall into the atmospheric layer to be decomposed after a mission is finished, so that the satellites out of operation will not become space trash.

Figure 1:
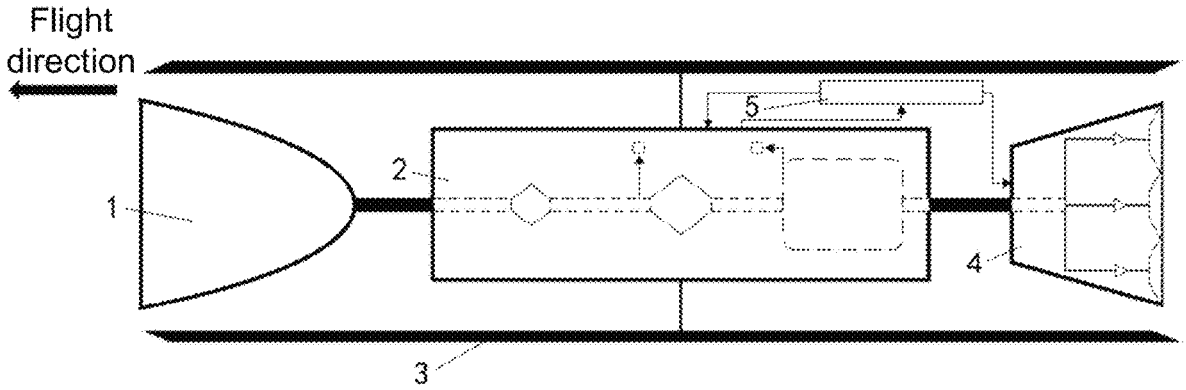
FIG. 1 is a structural diagram of a system.
Figure 2:
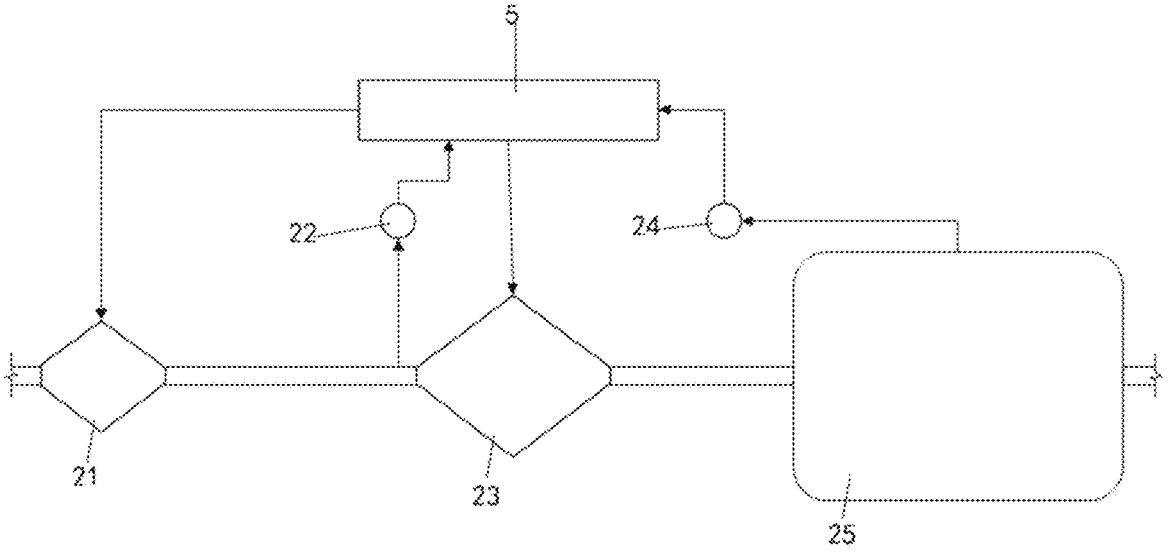
FIG. 2 is a structural diagram of an intelligent feedback pressurization system.
Figure 3:
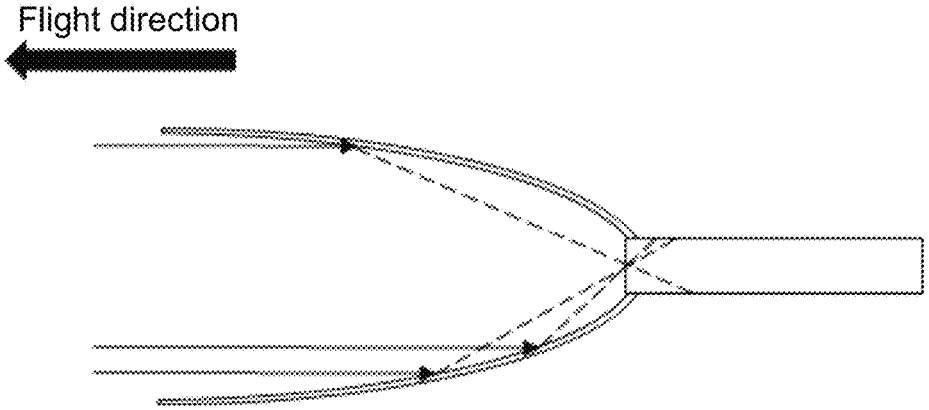
FIG. 3 is a working principle diagram of a gas intake duct in a free molecular flow state.
Figure 4:
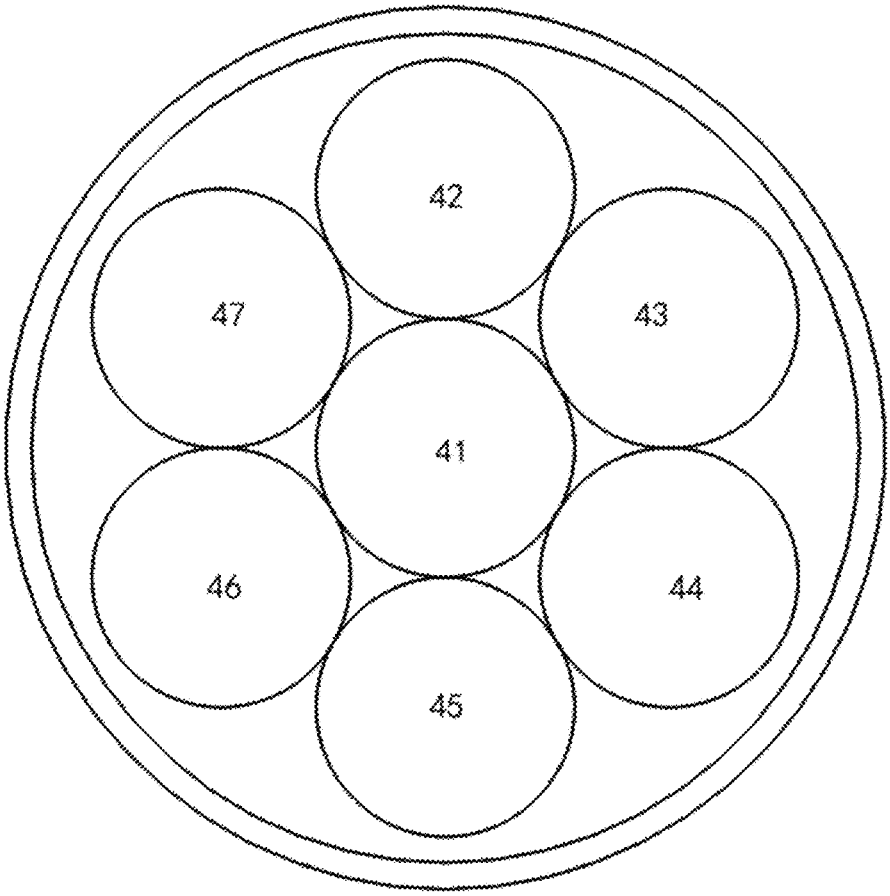
FIG. 4 is a structural diagram of a hybrid thruster system.
Figure 5:
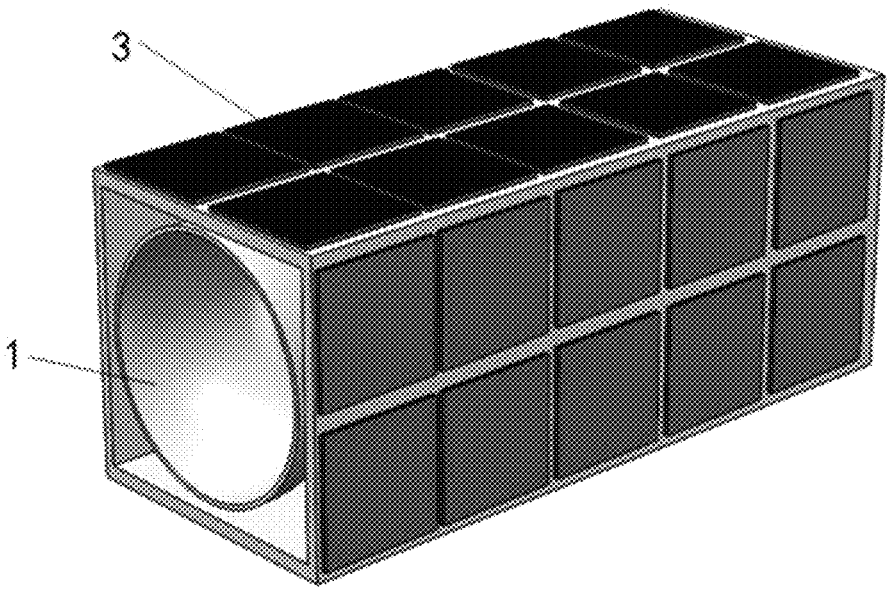
FIG. 5 is a schematic diagram of solar panels.

Reference Signs:

1, gas intake duct; 2, intelligent feedback pressurization system; 3, solar panel; 4, hybrid thruster system; 5, control system; 21, molecular pump; 22, first pressure gauge; 23, air pump; 24, second pressure gauge; 25, working medium storage tank; 41, first magnetic plasma thruster; 43, second magnetic plasma thruster; 45, third magnetic plasma thruster; 47, fourth magnetic plasma thruster; 42, first ion thruster; 44, second ion thruster; 46, third ion thruster.

DESCRIPTION OF THE EMBODIMENTS

The contents of the invention will be described in further detail below in conjunction with the accompanying drawings.

The invention is applied to an orbit at an altitude of 50 km-250 km, wherein an atmosphere below the orbit is in a continuous flow state, an atmosphere above the orbit is in a free molecular flow state, an atmosphere in the middle of the orbit is in a transitional flow state. With the increase of the altitude of the orbit, the atmospheric density decreases. Working modes in different flow states will be introduced separately.

An intelligent-control atmosphere-breathing electric propulsion system applicable to multiple flow states consists of a gas intake duct 1, an intelligent feedback pressurization system 2, a hybrid thruster system 4, a control system 5, and an energy supply system.

The gas intake duct 1 is parabolic and comprises a front inlet and a rear outlet, wherein the front inlet is a windward portion of the system, the rear outlet is connected to the intelligent feedback pressurization system 2, and the gas intake duct 1 is used for preliminarily compressing an incoming gas.

The intelligent feedback pressurization system 2 comprises a pump body, pressure gauges, and a working medium storage tank 25.

The pump body comprises a molecular pump 21 suitable for a free molecular flow, and an air pump 23 suitable for a low-pressure continuous flow, the molecular pump 21, the air pump 23, and the working medium storage tank 25 are serially connected in an incoming flow sequence, the molecular pump 21 is connected to the rear outlet of the gas intake duct 1, and a first pressure gauge 22 and a second pressure gauge 24 are disposed at a front end of the air pump 23 and the working medium storage tank 25 respectively, are connected to the control system 5, and are used for feedback control of power of the molecular pump 21 and power of the air pump 23 respectively.

The hybrid thruster system 4 comprises seven electric thrusters and seven flow-limiting valves, and the control system 5 controls power of the electric thrusters and a flow rate of the flow-limiting valves.

The seven electric thrusters of the hybrid thruster system 4 are arranged parallelly and closely, and comprise plasma thrusters and ion thrusters, the plasma thrusters comprise a first magnetic plasma thruster 41, a second magnetic plasma thruster 43, a third magnetic plasma thruster 45, and a fourth magnetic plasma thruster 47, and the ion thrusters comprise a first ion thruster 42, a second ion thruster 44, and a third ion thruster 46.

The control system 5 is provided with a wireless signal receiver and a wired signal input port, and controls working states of the intelligent feedback pressurization system 2 and the hybrid thruster system 4 by processing wireless remote control signals and input feedback signals.

The energy supply system comprises a battery and solar panels 3, wherein the solar panels 3 cover surfaces of a housing of the electric propulsion system, do not generate an extra resistance, and are kept in a charging state during work. The energy supply system is connected to the intelligent feedback pressurization system 2, the hybrid thruster system 4, and the control system 5, and supplies power to the intelligent feedback pressurization system 2, the hybrid thruster system 4, and the control system 5. To guarantee solar power supply efficiency, a satellite orbit employing the system is defined as a sun-synchronous orbit.

The gas intake duct 1 produces a shock wave effect in a continuous flow gaseous environment to compress an incoming gas flow, compresses incoming gaseous particles by means of a parabolic mirror-reflection focusing effect in a free molecular flow gaseous environment, and combines the two effects in a transitional flow state. After being preliminarily compressed, the gas enters the intelligent feedback pressurization system 2 to be further supercharged, so that a good compression effect is realized in different orbital atmospheric environments.

Negative feedback control of the working state of the molecular pump 21 is performed by the first pressure gauge 22. When an air pressure communicated with the first pressure gauge 22 does not meet working requirements of the air pump 23, the control system 5 increases the power of the molecular pump 21 to increase a gas density in the system. Generally, the molecular pump 21 works when an atmospheric environment is in a free molecular flow state.

Negative feedback control of the working state of the air pump 23 is performed by the second pressure gauge 24. When an air pressure of the working medium storage tank 25 communicated with the second pressure gauge 24 does not reach a rated value, the control system 5 controls the air pump 23 to work continuously. The smaller a reading of the second pressure gauge 24, the higher the working power of the air pump 23, so that it is guaranteed that a working medium in the working medium storage tank meets mission requirements. Generally, the air pump 23 works continuously when the system operates within a full orbit range.

Preferably, the hybrid thruster system 4 is provided with four magnetic plasma thrusters, namely the first magnetic plasma thruster 41, the second magnetic plasma thruster 43, the third magnetic plasma thruster 45, and the fourth magnetic plasma thruster 47, as well as three ion thrusters, namely the first ion thruster 42, the second ion thruster 44, and the third ion thruster 46, wherein in a low-orbit and high-flow rate environment, the magnetic plasma thrusters that require a high flow rate for ignition and have a large thrust density, namely the first magnetic plasma thruster 41, the second magnetic plasma thruster 43, the third magnetic plasma thruster 45, and the fourth magnetic plasma thruster 47, are started; and in a high-orbit and low-flow rate environment, the ion thrusters that require a low flow rate for ignition and have a small thrust density and a high control accuracy, namely the first ion thruster 42, the second ion thruster 44, and the third ion thruster 46, are started.

Preferably, a focus of a parabola of the parabolic gas intake duct 1 is located outside the rear outlet of the gas intake duct 1. In a free molecular flow environment, a thermal velocity of molecules is far smaller than a speed of an aircraft, and incoming molecules are regarded as a horizontal incoming flow. Because of the geometric focusing characteristic of the parabola, particles entering the gas intake duct will be focused to the focus of the parabola under the mirror-reflection effect of a wall of the gas intake duct; and the focus is designed to be located outside the rear outlet, so that the air-intake efficiency of the gas intake duct 1 is effectively improved, and a remarkable effect is realized.

Preferably, a coating on the wall of the gas intake duct 1 is a magnesium fluoride mirror coating suitable for an oxygenic high-temperature environment, so that the air-intake efficiency of a rarefied atmospheric free molecular flow is improved when the system works on a high orbit.

Preferably, a conductive portion of the hybrid thruster system 4 is coated with a gold coating, and a non-conductive portion of the hybrid thruster system 4 is made of a ceramic material; and an air duct at another position and the gas intake duct 1 are made of a stainless steel material containing nickel and molybdenum.

Preferably, the solar panels 3 of the energy supply system cover other surfaces except for an inlet surface of the gas intake duct 1 and an outlet surface of the hybrid thruster system, namely four surfaces with normals being perpendicular to a flight direction, so that the solar panels 3 will not generate any extra resistance.

Preferably, equipment on a satellite employing the electric propulsion system is disposed in a hexahedron formed by the gas intake duct 1, the hybrid thruster system 4, and the four solar panels 3, and the satellite is elongated to work under a minimum resistance.

Preferably, the seven thrusters in the hybrid thruster system 4 are arranged parallelly and closely, wherein the first magnetic plasma thruster 41 is located at a central point, and the other three magnetic plasma thrusters, namely the second magnetic plasma thruster 43, the third magnetic plasma thruster 45, and the fourth magnetic plasma thruster 47, and the three ion thrusters, namely the first ion thruster 42, the second ion thruster 44, and the third iron thruster 46, are alternately arranged with six vertexes of a regular hexagon as centers.

Preferably, one flow-limiting valve is connected to a front end of each of the seven electric thrusters in the hybrid thruster system 4, and the control system 5 controls the seven electric thrusters and the flow-limiting valves separately to realize different thrust states.

Preferably, the hybrid thruster system 4 is provided with four magnetic plasma thrusters, namely the first magnetic plasma thruster 41, the second magnetic plasma thruster 43, the third magnetic plasma thruster 45, and the fourth magnetic plasma thruster 47, as well as three ion thrusters, namely the first ion thruster 42, the second ion thruster 44, and the third ion thruster 46; and for special mission requirements, the two types of thrusters work collaboratively under the condition where the working medium in the working medium storage tank is sufficient, the working power of the thrusters and the flow rate of the flow-limiting valves are controlled by the control system 5 to accurately control thrust of the thrusters, and the thrust of the seven thrusters is controlled separately to generate a resultant force and a force moment to meet the mission requirements for orbital attitude control and resistance compensation.

The above description of the embodiments is used to assist those ordinarily skilled in the art in understanding and applying the invention. Obviously, those skilled in the art can easily make different modifications to the above embodiments, and apply the general principle described here to other embodiments without creative labor. So, the invention is not limited to the above embodiments. All improvements and modifications made to the invention by those skilled in the art according to the disclosure of the invention should fall within the protection scope of the invention.

What is claimed is:

1. An intelligent control gas suction-type electric propulsion system applicable to multi-flow regimes, comprising a gas intake duct, an intelligent feedback pressurization system, a hybrid thruster system, a control system, and an energy supply system, wherein the gas intake duct is parabolic and comprises a front inlet and a rear outlet, the front inlet is a windward portion of the system, the rear outlet is connected to the intelligent feedback pressurization system, and the gas intake duct is used for preliminarily compressing an incoming gas; the intelligent feedback pressurization system comprises a pump body, pressure gauges and a working medium storage tank; the pump body comprises a molecular pump suitable for a free molecular flow, and an air pump suitable for a low-pressure continuous flow, the molecular pump, the air pump, and the working medium storage tank are serially connected in an incoming flow sequence, the molecular pump is connected to the rear outlet of the gas intake duct, and a first pressure gauge and a second pressure gauge are disposed at a front end of the air pump and the working medium storage tank respectively, are connected to the control system, and are used for feedback control of power of the molecular pump and power of the air pump respectively; the hybrid thruster system comprises seven electric thrusters and seven flow-limiting valves, the seven electric thrusters are a first magnetic plasma thruster, a second magnetic plasma thruster, a third magnetic plasma thruster, a fourth magnetic plasma thruster, a first ion thruster, a second ion thruster, and a third ion thruster, and are arranged parallelly and closely, and the control system controls power of the electric thrusters and a flow rate of the flow-limiting valves; the control system is provided with a wireless signal receiver and a wired signal input port, and controls working states of the intelligent feedback pressurization system and the hybrid thruster system by processing wireless remote control signals and input feedback signals; the energy supply system comprises a battery and solar panels, and the solar panels cover surfaces of a housing of the electric propulsion system, do not generate an extra resistance, and are kept in a charging state during work; the energy supply system is connected to the intelligent feedback pressurization system, the hybrid thruster system, and the control system and supplies power to the intelligent feedback pressurization system, the hybrid thruster system, and the control system; the gas intake duct produces a shock wave effect in a continuous flow gaseous environment to compress an incoming gas flow, compresses incoming gaseous particles by means of a parabolic mirror-reflection focusing effect in a free molecular flow gaseous environment, and combines the two effects in a transitional flow state; after being preliminarily compressed, the gas enters the intelligent feedback pressurization system to be further supercharged, so that a good compression effect is realized in different orbital atmospheric environments; negative feedback control of the working state of the molecular pump is performed by the first pressure gauge; when an air pressure communicated with the first pressure gauge does not meet working requirements of the air pump, the control system increases the power of the molecular pump to increase a gas density in the system; negative feedback control of the working state of the air pump is performed by the second pressure gauge; when an air pressure of the working medium storage tank communicated with the second pressure gauge does not reach a rated value, the control system controls the air pump to work continuously; and the smaller a reading of the second pressure gauge, the higher the working power of the air pump, so that it is guaranteed that a working medium in the working medium storage tank meets mission requirements.

2. The intelligent control gas suction-type electric propulsion system applicable to multi-flow regimes according to claim 1, wherein the hybrid thruster system is provided with four magnetic plasma thrusters which are respectively the first magnetic plasma thruster, the second magnetic plasma thruster, the third magnetic plasma thruster, and the fourth magnetic plasma thruster, as well as three ion thrusters which are respectively the first ion thruster, the second ion thruster, and the third ion thruster, wherein in a high-flow rate environment, the first magnetic plasma thruster, the second magnetic plasma thruster, the third magnetic plasma thruster, and the fourth magnetic plasma thruster that require a high flow rate for ignition and have a large thrust density are started; and in a low-flow rate environment, the first ion thruster, the second ion thruster, and the third ion thruster that require a low flow rate for ignition and have a small thrust density and a high control accuracy are started.

3. The intelligent control gas suction-type electric propulsion system applicable to multi-flow regimes according to claim 1, wherein a focus of a parabola of the parabolic gas intake duct is located outside the rear outlet of the gas intake duct; in a free molecular flow environment, a thermal velocity of molecules is far smaller than a speed of an aircraft, and incoming molecules are regarded as a horizontal incoming flow; because of a geometric focusing characteristic of the parabola, particles entering the gas intake duct will be focused to the focus of the parabola under the mirror-reflection effect of a wall of the gas intake duct; and the focus is designed to be located outside the rear outlet, so that intake efficiency of the gas intake duct is effectively improved.

4. The intelligent control gas suction-type electric propulsion system applicable to multi-flow regimes according to claim 1, wherein a coating on a wall of the gas intake duct is a magnesium fluoride mirror coating suitable for an oxygenic high-temperature environment, so that air-intake efficiency of a rarefied atmospheric free molecular flow is improved when the system works in a low-flow rate environment.

5. The intelligent control gas suction-type electric propulsion system applicable to multi-flow regimes according to claim 1, wherein a conductive portion of the hybrid thruster system is coated with a gold coating, and a non-conductive portion of the hybrid thruster system is made of a ceramic material; and an air duct of the intelligent feedback pressurization system and the gas intake duct are made of a stainless steel material containing nickel and molybdenum.

6. The intelligent control gas suction-type electric propulsion system applicable to multi-flow regimes according to claim 1, wherein the solar panels of the energy supply system cover four vertical surfaces in a flight direction, wherein the flight direction is parallel to an inlet surface of the gas intake duct and an outlet surface of the hybrid thruster system, so that the solar panel will not generate any extra resistance.

7. The intelligent control gas suction-type electric propulsion system applicable to multi-flow regimes according to claim 1, wherein equipment on a satellite employing the electric propulsion system is disposed in a hexahedron formed by the gas intake duct, the hybrid thruster system, and four said solar panels, and the satellite is elongated to work under a minimum resistance.

8. The intelligent control gas suction-type electric propulsion system applicable to multi-flow regimes according to claim 1, wherein the seven thrusters in the hybrid thruster system are arranged parallelly and closely, wherein the first magnetic plasma thruster is located at a central point, and the other three magnetic plasma thrusters, namely the second magnetic plasma thruster, the third magnetic plasma thruster, and the fourth magnetic plasma thruster, and the three ion thrusters, namely the first ion thruster, the second ion thruster, and the third iron thruster, are alternately arranged with six vertexes of a regular hexagon as centers.

9. The intelligent control gas suction-type electric propulsion system applicable to multi-flow regimes according to claim 1, wherein one of the flow-limiting valves is connected to a front end of each of the seven electric thrusters in the hybrid thruster system, and the control system controls the seven electric thrusters and the flow-limiting valves separately to realize different thrust states.

10. The intelligent control gas suction-type electric propulsion system applicable to multi-flow regimes according to claim 1, wherein the hybrid thruster system is provided with four magnetic plasma thrusters which are respectively the first magnetic plasma thruster, the second magnetic plasma thruster, the third magnetic plasma thruster, and the fourth magnetic plasma thruster, as well as three ion thrusters which are respectively the first ion thruster, the second ion thruster, and the third ion thruster; and for a large resistance compensation requirement and an attitude adjustment requirements under a large resistance, the two types of thrusters work collaboratively under the condition where the working medium in the working medium storage tank is sufficient, the working power of the thrusters and the flow rate of the flow-limiting valves are controlled by the control system to accurately control thrust of the thrusters, and the thrust of the seven thrusters is controlled separately to generate a resultant force and a force moment to meet mission requirements for orbital attitude control and resistance compensation.

* * * * *